United States Patent [19]

Woodrow

[11] 3,973,425

[45] Aug. 10, 1976

[54] AXIAL PRELOADING DEVICE FOR AXIALLY ADJUSTABLE GROOVED WORK ROLLS

[75] Inventor: Harold E. Woodrow, Worcester, Mass.

[73] Assignee: Morgan Construction Company, Worcester, Mass.

[22] Filed: Nov. 7, 1974

[21] Appl. No.: 521,751

[52] U.S. Cl. ..... 72/247
[51] Int. Cl.[2] ..... B21B 31/18
[58] Field of Search ..... 72/247, 245, 238, 248

[56] References Cited

UNITED STATES PATENTS

| | | | |
|---|---|---|---|
| 2,016,016 | 10/1935 | Mikaelson et al. | 72/247 |
| 2,583,844 | 1/1952 | Hill et al. | 72/247 |
| 2,651,956 | 9/1953 | Peterson | 72/247 |
| 2,665,959 | 1/1954 | Hyams | 72/247 X |
| 3,842,640 | 10/1974 | Schmitt et al. | 72/238 |

*Primary Examiner*—Milton S. Mehr
*Attorney, Agent, or Firm*—Thompson, Birch, Gauthier & Samuels

[57] ABSTRACT

An axial preloading device is disclosed for use with axially adjustable grooved work rolls in a rolling mill. The work rolls are axially adjusted by a mechanism which includes relatively rotatable and reactive supporting components, and the preloading device exerts an axial force on the mechanism to eliminate mechanical backlash between the aforesaid components.

4 Claims, 5 Drawing Figures

AXIAL PRELOADING DEVICE FOR AXIALLY ADJUSTABLE GROOVED WORK ROLLS

BACKGROUND OF THE INVENTION

This invention relates generally to rolling mills, and is concerned in particular with an axial preloading device for use with axially adjustable grooved work rolls.

In rolling mills where mating pairs of grooved work rolls are employed to roll stock such as for example bar or rod, adjustment mechanisms are employed to individually adjust each roll axially through minute distances in order to bring the grooves of the mating rolls into accurate alignment. Such adjustment mechanisms usually include relatively rotatable components which are in threaded engagement with each other. Of necessity, the rotatable components are manufactured and assembled with working or running clearances therebetween. When the rolls are subsequently subjected to axial forces during the rolling operation, these clearances can produce a backlash which will have an adverse effect on groove alignment.

A primary object of the present invention is the provision of a device for preloading the axial roll adjustment mechanism to take up the working or running clearances between its relatively rotatable components, thereby eliminating backlash occasioned by axial forces exerted on the rolls during a rolling operation.

Another object of the present invention is the provision of an axial preloading device which does not interfere with roll parting adjustments made to the rolls during a rolling operation.

Still another object of the present invention is the provision of an axial preloading device which can be rapidly and easily moved to an inoperative position when removing and replacing work rolls.

SUMMARY OF THE INVENTION

According to the invention, an axial preloading device is provided on the roll housing adjacent to one end of each work roll. The preloading device preferably includes a rigid bridge member which is movable between an operative position overlying both the end of the work roll and the axial adjustment mechanism associated therewith, and a remote inoperative position which permits the roll and its bearings, chocks and adjustment mechanism to be removed from the housing as an integral unit. As previously indicated, the adjustment mechanism typically includes relatively rotatable components in threaded engagement with each other, with running or working clearances between the cooperating surfaces of the components. The bridge member carries a force exerting means which preferably comprises a hydraulically actuated piston-cylinder unit. The piston-cylinder unit acts through a roller and a bearing surface on other intermediate means on one of the relatively rotatable components. The roller is rotatable about an axis which is transverse to the rotational axis of the work roll, and also perpendicular to the plane containing the axes of both rolls. With this arrangement, the piston-cylinder unit may be employed to exert an axially directed preloading force on the axial roll adjustment mechanism, the said force being operative to take up the working or running clearances between the relatively rotatable and reactive supporting components. The arrangement of the aforesaid roller is such that the axial preloading force can be maintained without interfering with roll parting adjustments which are normally made during a rolling operation.

BRIEF DESCRIPTION OF THE DRAWINGS

An embodiment of the invention will now be described by way of example only, with reference to the accompanying drawings wherein.

DESCRIPTION OF PREFERRED EMBODIMENT

Figure 1:
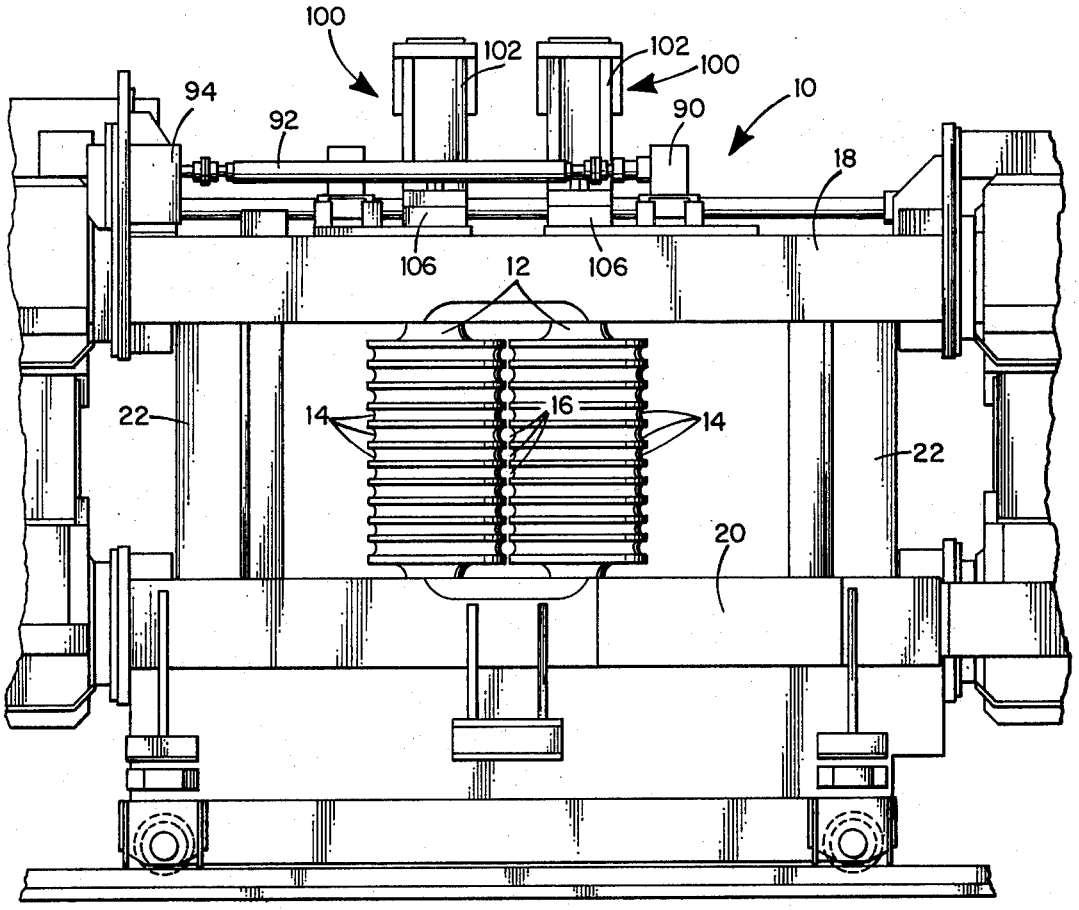
FIG. 1 is a front elevational view of a typical roll housing embodying the concepts of the present invention.

With reference now to the drawings, there is generally indicated at 10 a roll housing containing a pair of mating vertically arranged work rolls 12. The rolls are grooved as at 14, and the mating grooves form roll passes indicated typically at 16. Although not shown, it will be understood that conventional means are employed to vertically adjust the housing 10 in order to selectively align individual roll passes 16 with the center line of the mill. The housing 10 provides an integral rigid structure comprised basically of upper and lower horizontally extending support members 18, 20 which are interconnected by vertically disposed side members 22.

Figure 3:
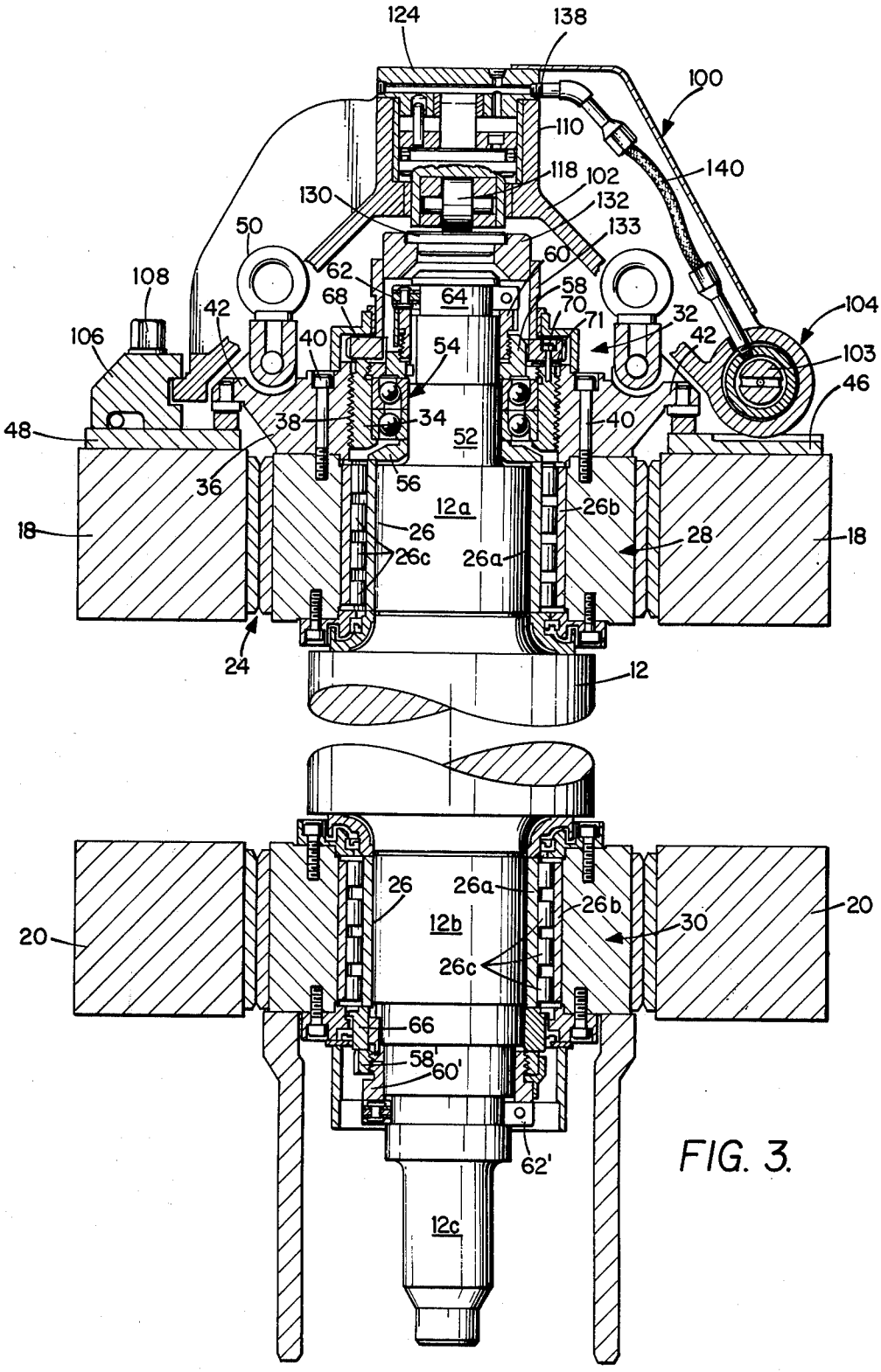
FIG. 3 is a vertical sectional view taken along lines 3—3 of FIG. 2.

As is best shown in FIG. 3, the upper and lower housing support members are laterally spaced to provide vertically aligned "windows" 24 into which are received the work rolls 12 and their associated components. The necks 12a, 12b of each work roll are journalled for rotation between bearing assemblies indicated generally at 26. The bearing assemblies are in turn contained in upper and lower chocks 28 and 30. The bearing assemblies 26 are of the roller type and are made up of inner and outer sleeves **26*a*, 26*b* with vertically spaced rollers 26*c* interposed therebetween. The inner sleeves 26*a* are mounted on the roll necks 12*a*, 12*b* for rotation therewith, and the outer sleeves 26*b* are fixed relative to the roll chocks 28, 30.**

Figure 4:
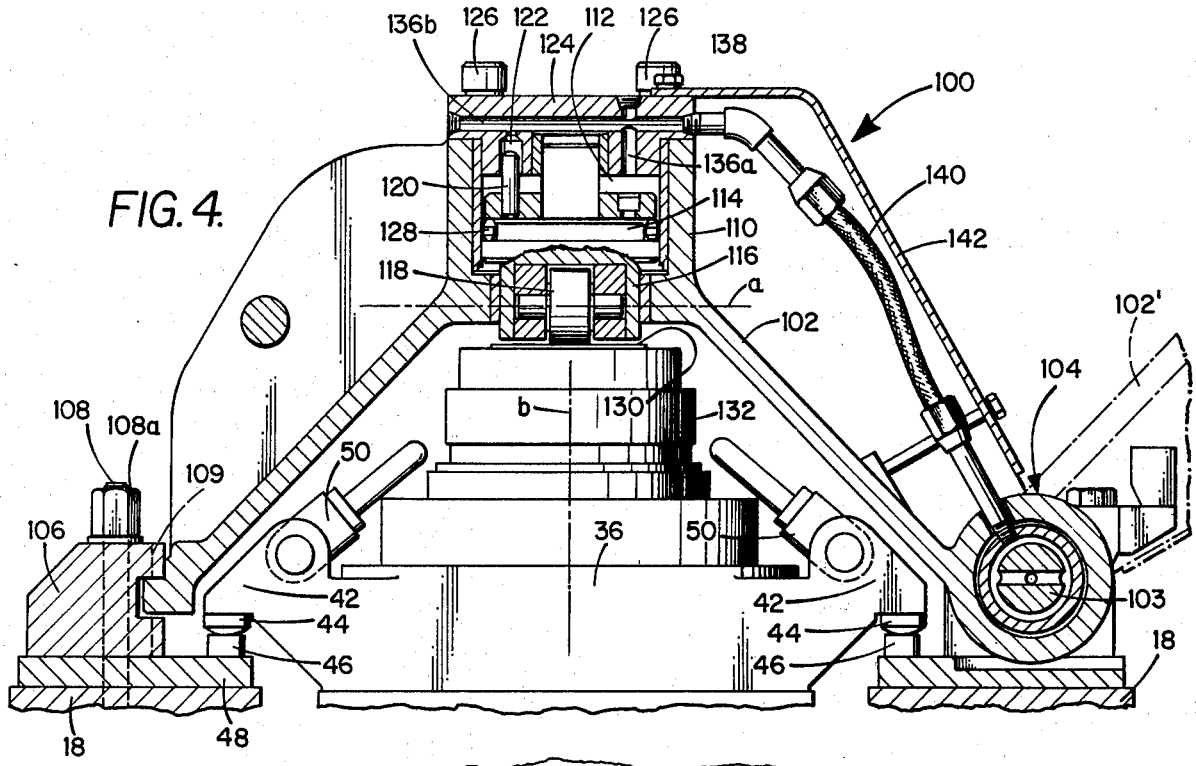
FIG. 4 is an enlarged partial sectional view of the upper portion of the apparatus shown in FIG. 3; and, FIG. 5 is a sectional view on an enlarged scale taken along lines 5—5 of FIG. 2.
Figure 2:
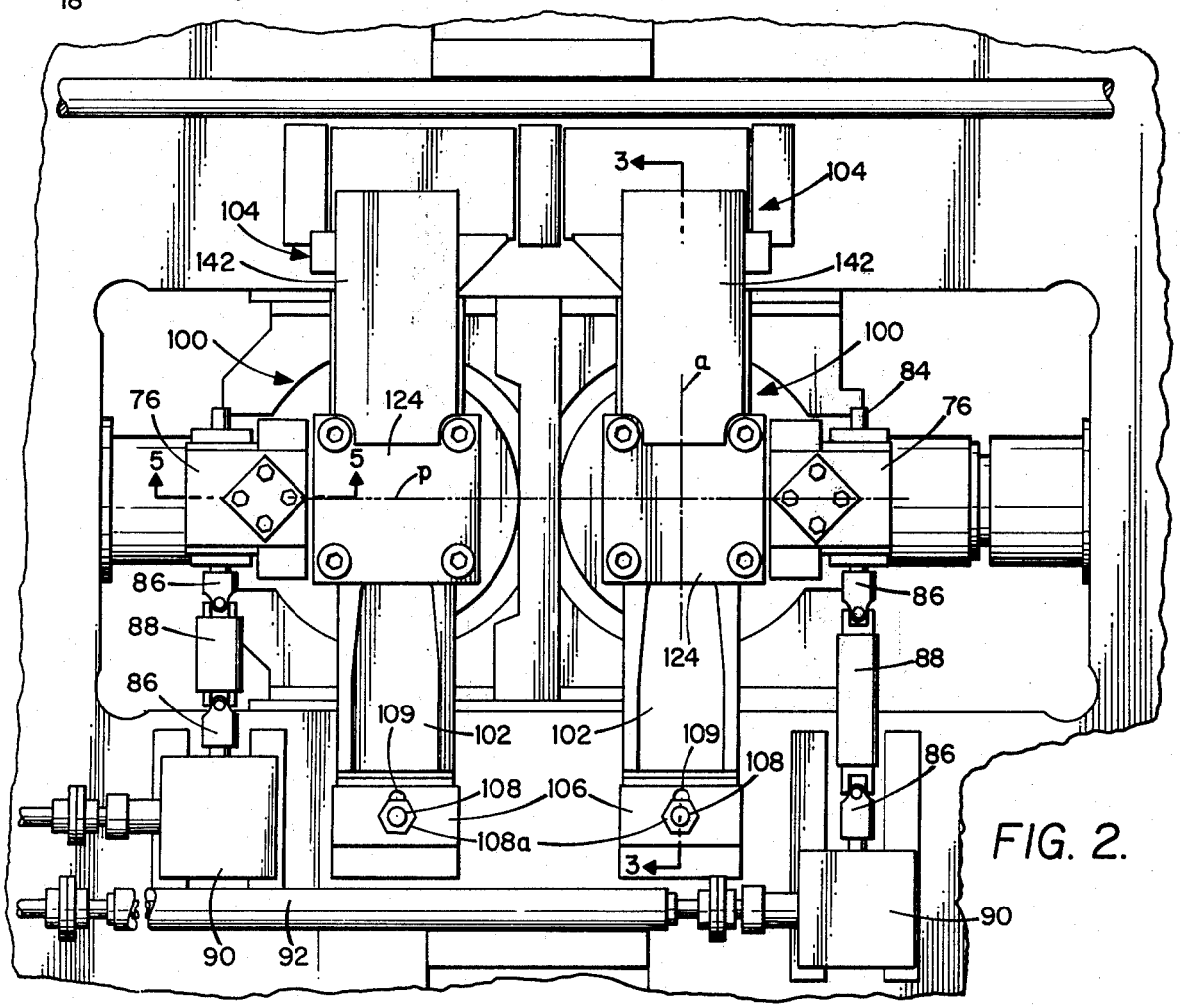
FIG. 2 is a plan view on an enlarged scale of a portion of the roll housing in FIG. 1.

The rolls 12 and the inner sleeves **26*a* mounted on the roll necks 12*a*, 12*b* are adjustable axially through minute distances on the order of $\pm 0.125$ relative to the rollers 26*c*, outer sleeves 26*b* and the chocks 28, 30. The mechanism for performing this axial adjustment is generally indicated at 32. Mechanism 32 includes an inner rotatable component 34 and an outer non-rotatable component 36. Components 34 and 36 are in threaded engagement with each other as at 38. The outer component 36 is secured to the upper chock 28 by means of bolts indicated typically at 40. As is best shown in FIG. 4, the outer component 36 has laterally extending ears 42 with convex downwardly facing buttons 44. The buttons sit on raised shoulders 46 on a plate 48 which forms the top portion of the housing 10. Pivotal lifting eyes 50 are attached to the ears 42.**

The inner component 34 is mounted on an upper axial extension 52 of the upper roll neck **12*a* by means of a roller thrust bearing assembly generally indicated at 54. The lower end of the thrust bearing assembly is in contact with a ring 56 which is in turn in contact with the inner sleeve 26***a* of the roller bearing 26. The upper end of thrust bearing assembly 54 is acted on by an internally threaded sleeve 58 which is in threaded engagement with an externally threaded sleeve 60, the latter in turn being in contact at its upper end with a split ring 62 seated in a groove 64 in the roll end. It will be understood that the split ring 62 and the threaded sleeves 58, 60 provide a means of removably mounting the thrust bearing assembly 54 and the inner sleeve 26*a* of the roller bearing assembly 26 on the work roll. A similar arrangement, which includes a split ring 62′, cooperating threaded sleeves 58′, 60′ and an intermediate ring 66 are employed to removably mount the inner sleeve 26*a* of the roller bearing 26 on the lower roll neck 12*b*. A further downward extension 12*c* of roll neck 12*b* is adapted for connection to a drive spindle coupling (not shown).

Figure 5:
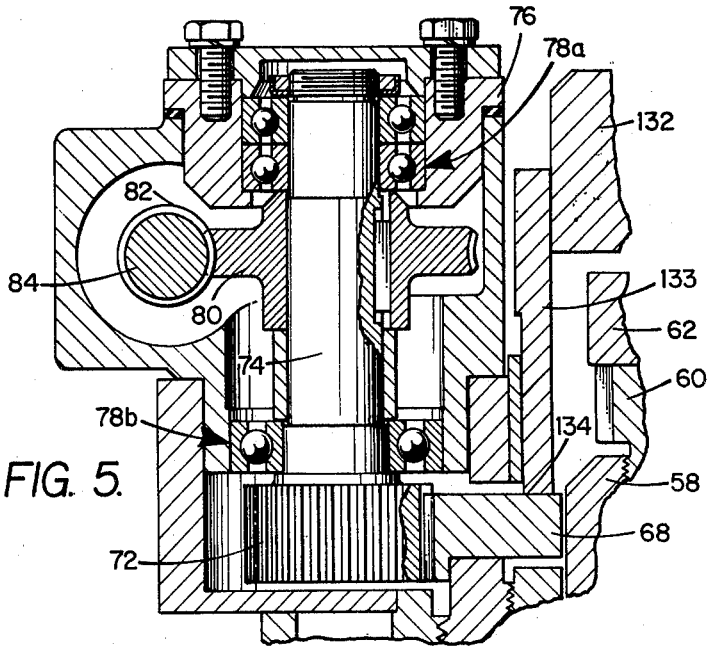

A gear 68 is secured to the inner rotatable component 34 of the axial roll adjustment mechanism 32 by any convenient means, such as for example the locking pin 70 and key 71 shown in FIG. 3. With reference to FIG. 5, it will be seen that gear 68 is in engagement with a gear 72 on the lower end of a short vertical shaft 74. Shaft 74 is contained within a small subhousing 76 and is suitably journalled for rotation between upper and lower roller bearing assemblies generally indicated at 78*a* and 78*b*. Shaft 74 carries a worm wheel 80 which meshes with a worm 82 on a shaft 84. The shaft 84 is driven by conventional means including couplings 86, an intermediate drive shaft 88, bevel gears (not shown) in gear housing 90 and another drive shaft 92 leading to a drive motor 94. Motor 94 may be energized manually or by automatic control means when axially adjusting the work roll, with the actual adjustment being caused by rotating the inner rotatable component 34 of the axial roll adjustment mechanism 32 in relation to the outer non-rotatable component 36.

Although the previous description has centered on only one of the rolls 12, it will be understood that both work rolls are mounted, driven and axially adjusted in the same way.

As previously mentioned, it is necessary to provide running or working clearances as at 38 between the inner rotatable component 34 and the outer non-rotatable component 36 of the axial roll adjustment mechanism 32. When the roll is subjected to axial forces during a rolling operation, these clearances can produce a backlash which will have an adverse effect on the accuracy of axial roll adjustments previously imparted to the work roll. To eliminate this problem, the present invention includes the provision of an axial preloading device generally indicated at 100 for each work roll. The device comprises a rigid bridge member 102 which is pivotally mounted at one end as at 104 by means including a pivot pin 103 to the roll housing 10. When in its operative position overlying the upper roll end and the axial adjustment mechanism associated therewith, the bridge member is fixed at its opposite end relative to the roll housing by means of a clamp 106 which is secured to the housing by any convenient means such as the bolts 108 and nuts 108a depicted in the drawings. The bolts 108 extend vertically through slots 109 in the clamp 106. When the nuts 108*a* are loosened, the clamp 106 can be moved back and the bridge member 102 may then be pivoted to an inoperative position as partially indicated by the dot-dash lines at 102′ in FIG. 4.

With further reference to FIG. 4, it will be seen that the bridge member 102 has a somewhat centrally located head section 110 forming an interior cylinder 112 containing an axially movable piston 114. The lower end of the piston has a reduced diameter as at 116 which extends through an opening at the bottom of the cylinder, and which has mounted thereon a roller 118. The roller is rotatable about an axis *a* which is transverse to the rotational axis *b* of the underlying work roll 12, and perpendicular to a plane *p* containing the rotational axes of both work rolls. This relationship is maintained by a locating pin 120 on the piston 114 which is slidably received in an opening 122 in the cylinder head 124, the latter being fixed to the head section 110 by bolts 126. A ring seal 128 is provided between the piston 114 and inner cylinder wall.

When the bridge member 102 is operatively positioned, the roller 118 contacts the flat horizontal nose 130 of a cap 132 which has a depending cylindrical section 133 seated as at 134 (see FIG. 5) on the gear 68 connected to the rotatable inner component 34 of the axial roll adjustment mechanism 32. The piston 114 is actuated by hydraulic fluid fed under pressure into the cylinder 112 through communicating conduits 136a and 136b in the cylinder head 124. In the preferred form herein depicted, conduit 136b is connected as at 138 to a conduit 140 which leads downwardly under a cover plate 142 on the bridge member 102 to the pivotal connection 104 through which hydraulic fluid is passed in a known manner.

In the light of the foregoing, it will now be understood that by actuating piston 114 through the introduction of pressurized hydraulic fluid into chamber 112, an axial preloading force is directed downwardly through roller 118 against the nose 130 of cap member 132. This force is transmitted through cap member 132 and gear 68 to the rotatable inner component 34 of the axial roll adjustment mechanism 32, thereby taking up any running or working clearances that might otherwise produce a harmful backlash when the rolls are subsequently exposed to axial forces during a rolling operation. An equal and opposite force to that exerted on the nose 130 of cap members 132 will of course be exerted on the bridge member 102. This opposite force will shared between and absorbed at clamp 106 and pivotal connection 104, thereby taking up any clearances at these locations as well. Preferably, the preloading force is adjustable so that a reduced force is exerted during axial roll adjustments to permit rotation of inner component 34 relative to outer component 36 while still taking up all clearances. After axial adjustments have been completed, the preloading force can be increased to a higher level.

The position of the roller 118 is such that its rotational axis *a* is transverse to that of the underlying roll and perpendicular to the plane *p* containing the axes of both work rolls. This is advantageous in that it allows the preloading force to be maintained during the rolling operation and while roll parting adjustments are being made to the rolls. Another advantageous feature of the invention is that by simply backing off clamp 106, the bridge member 102 can be quickly and conveniently pivoted to an inoperative position 102′, thereby providing full access to the upper end of the roll. Thereafter, by utilizing the lifting eyes 50, the roll together with its bearings, chocks, and axial roll adjustment mechanism can be lifted out of the roll housing as an integral unit and replaced with another fresh unit whenever a roll change is required.

Although the invention has been described in connection with vertical rolls, it will be understood that the same concepts are applicable to horizontal rolls. It is my intention to cover all changes and modifications to the embodiment herein chosen for purposes of disclosure which do not depart from the spirit and scope of the invention as claimed.

I claim:

1. In a rolling mill having a work roll journalled for rotation between bearings contained in chocks, the said chocks being adapted to be removably mounted in a roll housing, with an adjustment means having one component which is rotatable in relation to another component for axially adjusting the work roll in relation to said chocks, the improvement comprising a fluid-actuated piston-cylinder assembly for exerting an axially directed force on said adjustment means to thereby eliminate mechanical backlash between said components.

2. The apparatus as claimed in claim 1 wherein said work roll, bearings, chocks and adjustment means are axially removable as a unit from said roll housing, and wherein said fluid-actuated piston-cylinder assembly is carried on a bridge member which is mounted on said housing for movement between an operative position overlying one end of said unit, and a remote inoperative position which will permit axial removal of said unit from said roll housing.

3. The apparatus as claimed in claim 2 further characterized by a cap member having a bearing surface overlying one end of the work roll and a cylindrical extension in contact with one of said components, said fluid-actuated piston-cylinder assembly having a roller engageable with said bearing surface and rotatable about an axis which is transverse to the rotational axis of the work roll and perpendicular to the direction of roll movement during roll parting adjustments.

4. In a rolling mill having a work roll journalled for rotation between bearings contained in chocks, the said chocks being adapted for removable mounting in a roll housing, with adjustment means having one component which is rotatable in relation to another component surrounding one end of the work roll for axially adjusting the work roll in relation to the chocks, there being working clearances between said components, the improvement comprising: a bridge member pivotally connected at one end to said roll housing, said bridge member being movable between an operative position overlying the said one end of the work roll and a remote inoperative position permitting axial removal of said work roll from said housing; clamp means on said housing, said clamp means being engageable with the other end of said bridge member when said bridge member is in said operative position, thereby rigidly securing said bridge member relative to said housing; a cap member having a bearing surface overlying one end of the work roll and having a cylindrical extension contacting one of said components, and a piston-cylinder unit carried by said bridge member, the piston of said unit having a roller associated therewith which roller is adapted to engage said bearing surface when said bridge member is in said operative position, whereupon when pressurized hydraulic fluid is fed to said piston-cylinder unit, an axially directed force is exerted on said adjustment means by said piston acting through said roller against said bearing surface.

* * * * *